US006732455B2

(12) United States Patent
Bordin et al.

(10) Patent No.: US 6,732,455 B2
(45) Date of Patent: May 11, 2004

(54) COMFORT UPPER FOR FOOTWEAR

(75) Inventors: Mario Bordin, Asolo (IT); Mariarosa Romanato, Stra (IT)

(73) Assignee: Salomon S.A., Metz-Tessy (FR)

( * ) Notice: Subject to any disclaimer, the term of this patent is extended or adjusted under 35 U.S.C. 154(b) by 0 days.

(21) Appl. No.: 09/888,479

(22) Filed: Jun. 26, 2001

(65) Prior Publication Data

US 2001/0054240 A1 Dec. 27, 2001

(30) Foreign Application Priority Data

Jun. 27, 2000 (FR) ..... 00 08350

(51) Int. Cl.[7] ..... A43B 7/20; A43B 7/14; A43B 5/04; A43B 23/60

(52) U.S. Cl. ..... 36/89; 36/93; 36/58; 36/117.1

(58) Field of Search ..... 36/87, 88, 89, 36/92, 93, 3 R, 3 A, 10, 58, 68, 71, 72 B, 117.1, 117.6

(56) References Cited

U.S. PATENT DOCUMENTS

| | | | | | |
|---|---|---|---|---|---|
| 3,616,170 | A | * | 10/1971 | Closson, Jr. | 36/77 |
| 3,778,251 | A | * | 12/1973 | Trask | 36/68 |
| 3,925,916 | A | * | 12/1975 | Garbuio | 36/71 |
| 4,229,546 | A | * | 10/1980 | Swan, Jr. | 36/117.6 |
| 4,523,392 | A | * | 6/1985 | Gabrielli | 36/10 |
| 4,562,607 | A | * | 1/1986 | Trask | 36/68 |
| 5,607,745 | A | * | 3/1997 | Ogden | 36/44 |
| 5,746,015 | A | * | 5/1998 | Clement et al. | 36/10 |
| 5,761,835 | A | * | 6/1998 | Okajima | 36/89 |
| 5,771,609 | A | * | 6/1998 | Messmer | 36/89 |
| 6,079,128 | A | * | 6/2000 | Hoshizaki et al. | 36/89 |
| 6,168,172 | B1 | * | 1/2001 | Meibock et al. | 36/89 |
| 6,189,172 | B1 | * | 2/2001 | Back | 36/117.1 |
| 6,233,845 | B1 | * | 5/2001 | Belli | 36/88 |
| 6,233,848 | B1 | * | 5/2001 | Bonaventure | 36/92 |
| 6,405,457 | B1 | * | 6/2002 | Basso et al. | 36/89 |

FOREIGN PATENT DOCUMENTS

| | | |
|---|---|---|
| EP | 0769258 | 4/1997 |
| EP | 0861609 | 9/1998 |
| FR | 2726743 | 5/1996 |
| FR | 2738999 | 3/1997 |

* cited by examiner

*Primary Examiner*—Anthony D. Stashick
(74) *Attorney, Agent, or Firm*—Greenblum & Bernstein, P.L.C.

(57) ABSTRACT

A comfort upper for footwear adapted in particular to equip a sports boot and an inner liner for a sports boot. The upper includes a stiffener, positioned between the inner lining and the outer covering, which is made of a thermoformable material. The upper also includes a comfort element, positioned between the inner lining and the stiffener, which is softer than the stiffener and which is possibly made of thermoformable material. This comfort element includes perforations enabling the thermoforming of the stiffener by propulsion of hot air within the footwear.

31 Claims, 3 Drawing Sheets

COMFORT UPPER FOR FOOTWEAR

CROSS-REFERENCE AND RELATED APPLICATIONS

This application is based upon French Patent Application No. 00 08350, filed on Jun. 27, 2000, the disclosure of which is hereby incorporated by reference thereto in its entirety, and the priority of which is hereby claimed under 35 U.S.C. §119.

BACKGROUND OF THE INVENTION

1. Field of the Invention

The present invention relates to a comfort upper for footwear adapted in particular, but in a non-limiting manner, to sports such as alpine skiing, telemark skiing, snowboarding, in-line roller and ice skating, as well as for use as a boot for cross-country skiing and snowshoeing. The invention is also directed to the footwear itself incorporating such comfort upper.

2. Description of Background and Relevant Information

In the state of the prior art, especially in the field of alpine ski boots, there are numerous thermoformable liner systems that make it possible to fill the volume located between the user's foot and the interior of a rigid shell that constitutes the outer frame of the boot. The variation of the liner volume to adjust to the user's foot can be obtained mainly in two ways. First, a previously thermo-compressed material can be relaxed by heating. Second, the foot can simply compress a heated material that cools off while preserving the shape imparted by the foot, it being possible to perform this operation in a store, i.e., at a sales location.

According to another technique, the liner is entirely constituted of a thermoformable material, and the liner is heated in an oven. Conversely, if the liner includes localized thermoformable inserts inserted in a conventional liner structure, the heating can only occur from within the liner so that the heat does not deteriorate the outer covering of the liner.

In fact, the document FR 2 726 743, and its family member U.S. Pat. No. 5,746,015, improves this system by describing micro-perforations in the thermoformable foam that is inserted in this type of liner. This process makes it possible to optimize the preheating of the foam.

However, the previously described thermoformable liners, which are currently used mainly in alpine ski boots and in-line roller skate boots, i.e., boots having a rigid outer upper or shell, are incompatible with possible stiffeners providing the liner with a certain rigidity. Indeed, the conventional stiffeners to be inserted in the liners or boots are generally made of a non-thermoformable plastic and therefore cannot be adapted to the user's foot. And even if certain stiffeners can be shaped by thermoforming during manufacture, before assembly of the liner, they conform to a standard foot that does not necessarily correspond to the specific morphology of each user's foot.

Moreover, the current thermoformable liners cannot be equipped with a tightening system such as laces, because the thermoformable materials used are of the foam type, are flexible and, therefore, are not adapted to resist traction. Furthermore, they do not have an adequate rigidity to properly distribute the localized pressure generated by the lacing at the level of the lace guides. This technology does not make it possible to obtain inner comfort liners equipped with a lacing system by thermoforming. However, this type of liner would be particularly adapted to boots having a flexible or semi-rigid upper and used in particular for snowboarding

SUMMARY OF THE INVENTION

Therefore, one of the objects of the invention is to propose a comfort upper for footwear having, in particular, a flexible or semi-rigid outer upper while having a certain rigidity, which makes it possible to adapt to the foot morphology by thermoforming.

Another object of the invention is to propose an upper that makes it possible to comfortably distribute the localized pressure generated by a tightening system associated with the upper of the footwear.

To achieve these objects, the upper of the footwear includes a stiffener made out of a thermoformable material capable of being configured around the user's foot. This stiffener is positioned between the inner lining, in contact with the foot, and the outer covering of the footwear. In addition, the upper includes a comfort element, positioned between the inner lining and the stiffener, which can be made of a thermoformable material. To better distribute the pressure generated by the fastener of the tightening system, which is arranged on one of the portions of the upper to be brought closer, the stiffener includes at least one arm whose end is positioned substantially beneath the fastener. In addition, the comfort element includes perforations that enable hot air to reheat the stiffener so as to ensure good thermoforming conditions.

In a first embodiment, the perforations open out on the stiffener.

In a second embodiment, the perforations, which are located outside the stiffener, open out on a ventilated layer that is positioned between the stiffener and the outer covering.

BRIEF DESCRIPTION OF DRAWINGS

The invention will be better understood and other advantages thereof will become apparent from the description that follows, with reference to the annexed drawings. The description illustrates, by way of non-limiting examples, certain preferred embodiments.

DETAILED DESCRIPTION OF THE INVENTION

Figure 1:
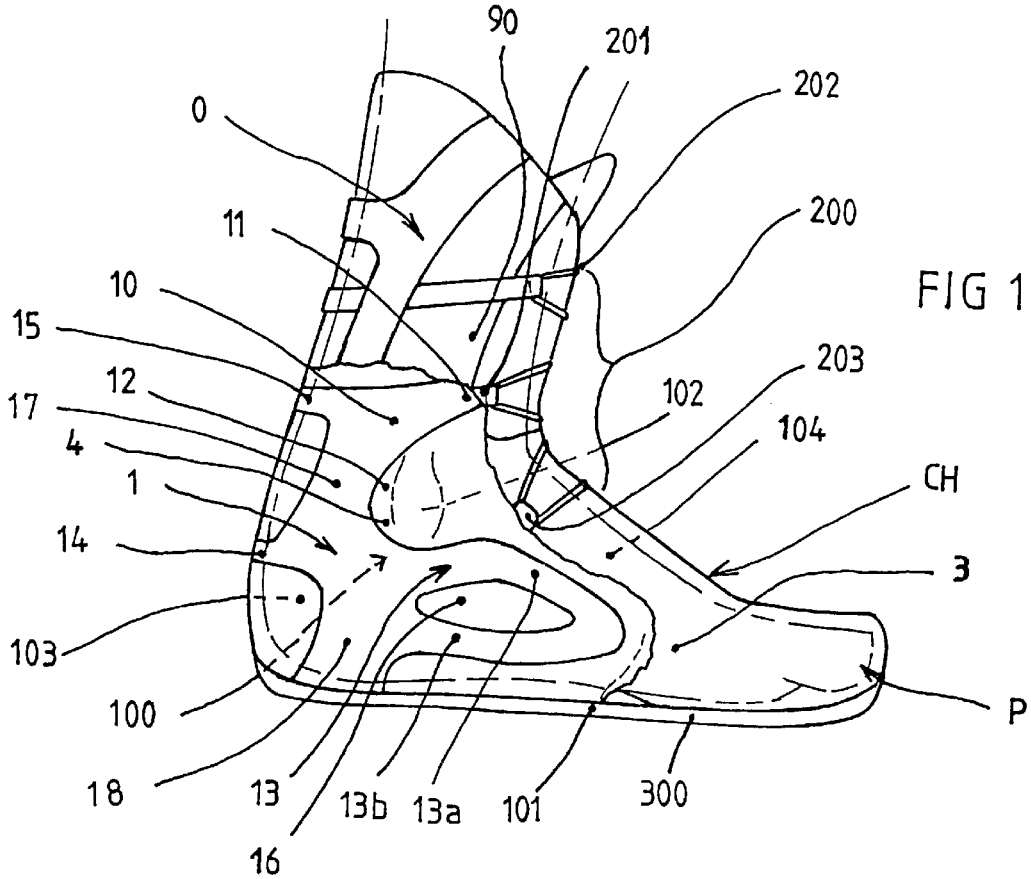
FIG. 1 schematically shows a side view of an inner liner whose upper, which is consistent with the first embodiment, broken away in the area of the ankle.

FIG. 1 shows an item of footwear CH that is represented by an inner liner made of a flexible material used in particular in snowboard boots. The liner CH could be used for alpine skiing, mountain skiing, telemark skiing, in-line roller skating and ice skating, and more generally for any sports where a liner is surrounded by an envelope B, shown in FIG. 2*a*, schematically by means of a broken line surrounding the outer periphery of the liner CH. Such envelope can be either rigid or flexible. The liner CH includes an upper O that overlays a sole 300. The upper O includes an outer covering 3 surrounding an inner lining in contact with the foot P which is represented in FIG. 1 by broken lines. The inner lining has the function of providing comfort during contact with the foot P, whereas the outer covering 3 makes it possible to ensure a holding of the liner CH, as well as a resistance to abrasion with respect to the envelope in which the liner CH is inserted.

The upper O also includes a stiffener 1, positioned between the inner lining and the outer covering 3, which is made out of a thermoformable material.

A thermoformable material here means that it has the property to deform at a predetermined temperature under the effect of an external force, and to preserve this deformation, or at least a portion of this deformation, when cooling off. Moreover, this predetermined temperature should not be too high to prevent the foot from burning.

The stiffener 1, applied in the thickness of the upper O, has a flattened geometry whose thickness is positioned in the thickness of the upper O. Thus, the geometry, having the width applied in the upper O, has a greater inertia along the preferred direction of the forces, especially in forward bending. The stiffener 1 therefore makes it possible to provide the liner CH with a certain rigidity, especially as it can be advantageously more rigid than the outer covering 3. The thermoformable nature of the stiffener 1 makes it possible to better adjust the upper O of the liner CH to the user's foot P, and thus to customize the fitting properties.

The stiffener 1 can be made of a textile material impregnated with thermoplastic resin, such as, for example, the material sold under the trademark RHENOFLEXE®, having a thickness within the range of about 0.5 and 3.0 mm.

The upper O includes a comfort element 4 that is positioned between the stiffener 1 and the inner lining, and therefore positioned beneath the stiffener 1. The comfort element 4 is made of a softer material than the constituent material of the stiffener 1 in order to fulfill its role of providing comfort. This comfort element 4 can advantageously extend beneath the stiffener 1, as well as along the periphery of the stiffener 1 in order to attenuate the changes in rigidity between the edge of the stiffener 1 and the areas that are not equipped with the stiffener. Moreover, to improve the comfort of the upper O, the comfort element 4 can advantageously be made of a thermoformable material of the foam type, about 1–10 mm thick, made, for example, by mixing a first polyethylene compound and a second ethylene-vinyl acetate compound.

The stiffener 1 and the comfort element 4 can be fixed to the outer covering 3 of the upper O of the footwear article CH by a known connection means. This connection means can be glue, that resists thermoforming, or a seam assembly, such as stitching. The thermoforming is generally obtained after raising the temperature of the material to be thermoformed within the range of about 100° C. and 140° C.

In the sports practiced in which the present upper O is adapted to be used, the liner CH needs to be stiffened in the area of the ankle joint 100, in particular to limit the forward bending. To achieve this object, the stiffener 1 is positioned laterally on the upper O, in the area of the ankle joint 100, thus having its greatest inertia in the direction of forward bending. Similarly, so that the stiffener 1 does not induce an interfering twisting during the forward bending, the stiffener 1 can be advantageously configured symmetrically in relation to the foot P.

The stiffener 1 can also include at least one arm 13 that extends from the ankle 100 up to substantially the metatarsophalangeal joint 101 of the foot P. This arm 13 in particular makes it possible to distribute the bending forces, recovered by the stiffener 1, in the area of the ankle 100, over a larger zone of the foot P. Respecting these constructional arrangements makes it possible to stiffen the liner CH, while respecting the bending biomechanics of the foot P and ankle 100, and limiting the twisting of the knee.

To practice certain sports, such as in-line roller skating, it can be advantageous to substantially stiffen the liner CH laterally. However, the stiffener 1 also makes it possible to laterally stabilize the ankle 100, even if the stiffener 1 has its thickness, and therefore, its inertia, in this direction. To obtain this rigidity, two solutions can be selected.

First, one can seek to laterally extend the stiffener 1 to the maximum along the liner CH. In this case, the stiffener 1 advantageously includes a recess 12 in the area of the malleolus 102 of the ankle 100. This recess 12 can be covered by the comfort element 4 to procure the best possible comfort in the area of this sensitive area, i.e., the malleolus 102. This recess 12 extends advantageously beyond the theoretical area of the malleolus 102 for a standard foot, in order to take into account the statistical dispersion of the malleolus 102 along the foot P of the users.

Second, the stiffeners 1, arranged laterally and symmetrically with respect to the foot P, can be joined by at least one band 14, 15. The band 14 can be advantageously positioned substantially along the horizontal line above the heel 103 in order not to create any hard spot on the heel. The comfort element 4 can also be advantageously positioned and can extend on the upper O in the area of the heel 103.

During the practice of certain sports, in particular those, such as snowboarding, telemark skiing, in which a flexible or semi-rigid envelope surrounding the liner is used, the upper O can be advantageously equipped with a tightening system 200. In a known fashion, the tightening system 200 includes at least one fastener 201 arranged on one of the portions 90 of the upper O to be brought closer. Similarly, at least one other fastener is arranged on the other portion of the upper in order to be able to bring the two portions 90 of the upper O closer together by a known tightening means such as a lace 202. The tightening system 200 in particular make it possible to obtain a better contact of the liner CH on the foot P and, thereby, a better precision of the boot, especially if the boot can envelope the liner CH precisely, due in particular to another tightening system positioned on the envelope.

In view of the problems mentioned in the prior art for the tightening systems on a thermoformable liner, it is interesting to use the rigidity of the stiffener 1 to distribute over the foot P, through the liner CH, the localized pressure generated by the tightening system 200 on the fasteners 201. Therefore, the stiffener 1 can advantageously include at least one arm 10 whose end 11 is positioned substantially beneath the fastener 201. Thus, the fastener 201 on which the tightening system 200 no longer punches the liner CH locally, but rests on the stiffener 1. The stiffener 1 then distributes the pressure on the foot P in a more homogenous manner.

In the preferred geometry, the stiffener 1 includes, at least on one lateral surface of the upper O, a main body 17 that extends vertically behind the malleolus 102. The main body 17 is extended forwardly, above the malleolus 102 along the arm 10, up to the area of the fastener 201 of the tightening system.

Advantageously, the main body 17 of the stiffener 1 extends rearwardly, in the area of the arm 10, along a band 15 that joins, from the rear, the two main bodies 17 arranged symmetrically with respect to the foot P. In addition, the main body 17 extends forwardly along the arm 13 that passes beneath the malleolus 102. The upper portion 13*a* of the arm 13 extends substantially beneath the fasteners 203 of the tightening system 200 that are located in the zone of the instep 104. The arm 13 also includes a lower portion 13*b* separated from the upper portion 13*a* by a recess 16. This recess 16, positioned substantially along the horizontal line, in the area of the lateral edge of the foot, makes it possible not to exert pressure in this zone of the foot P which would be painful.

The main body 17 of the stiffener 1 can also advantageously extend downwardly by a leg 18 that is anchored in the sole 300. This leg 18 is connected toward the front to the arm 13 and does not overly extend toward the rear in order to leave a free space in the area of the heel 103. This leg 18 is substantially perpendicular to the malleolus 102 along the vertical line, or slightly at the rear along a perpendicularity between the malleolus 102 and the heel 103. In addition, the leg 18 of the stiffener 1 can advantageously be connected to the band 14 in the area of the linkage with the main body 17.

Figure 2:
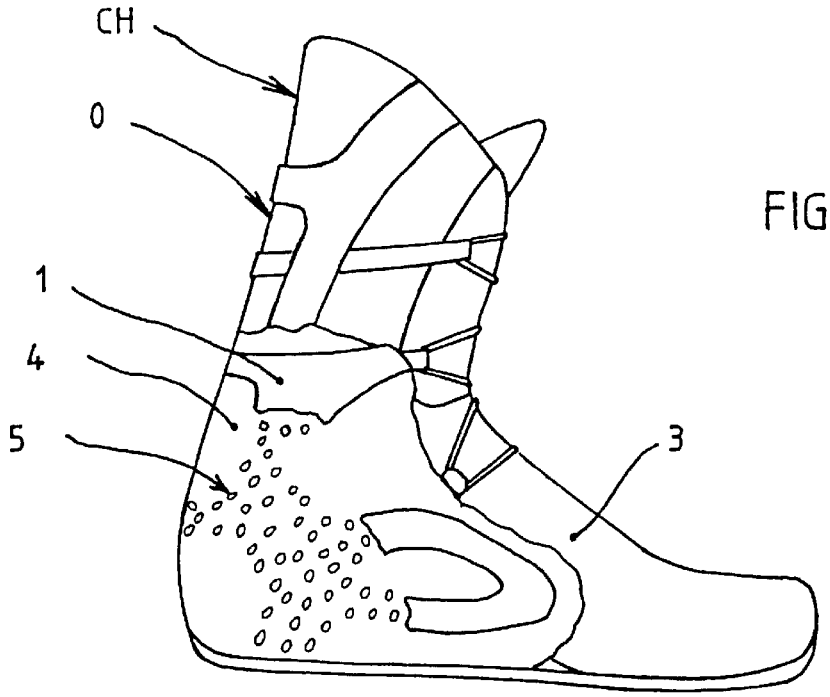
FIG. 2*a* schematically shows an envelope, in the form of an outer boot, surrounding the inner liner of the invention.
Figure 2A:
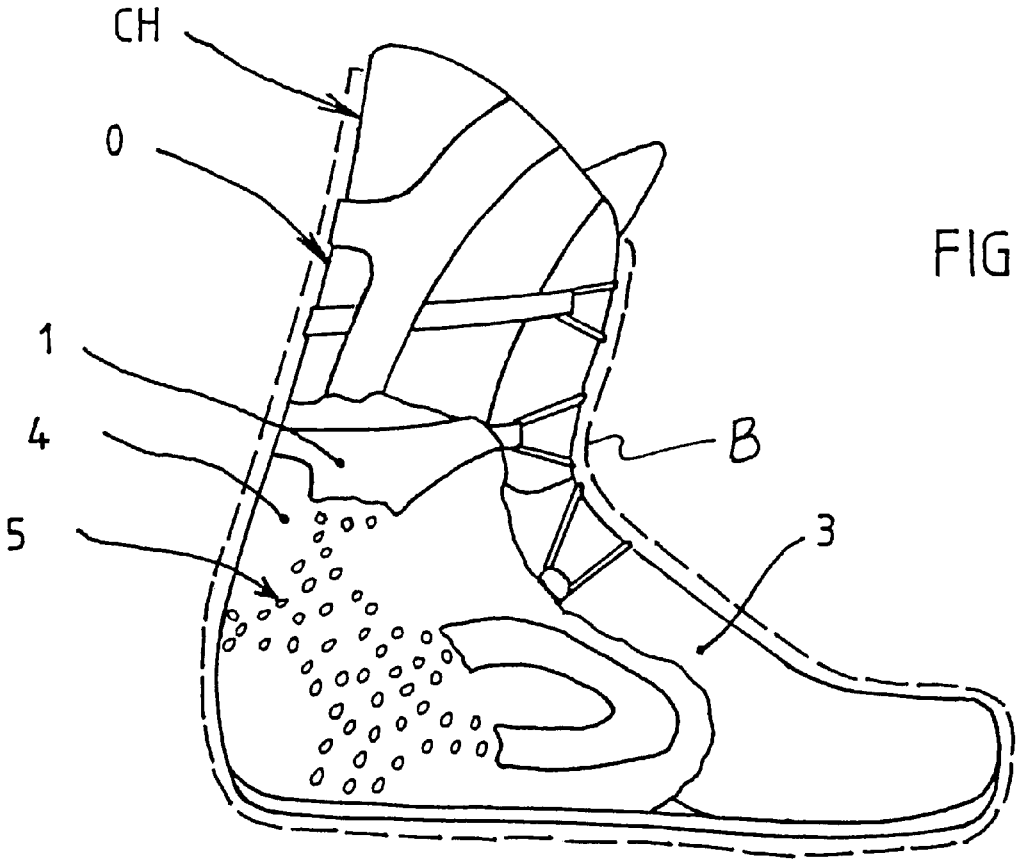

In FIG. 2, the footwear article CH is still illustrated by a liner inside a boot used in particular for snowboarding. The upper O of the liner CH, as shown in the figure, has a first region broken away in the area of the outer covering 3 that shows the stiffener 1, as well as the comfort element 4. A second region is broken away in the area of the stiffener 1, making it possible to see the portion of the comfort element 4 that is located beneath the stiffener 1. The comfort element 4 includes perforations 5 that are preferably through perforations. These perforations 5 enable the thermoforming hot air, diffused from within the liner CH, to penetrate into the material, in particular in the area of the comfort element 4, when the latter is made out of a thermoformable material. Moreover, the perforations 5 can advantageously be arranged beneath the stiffener 1, as currently shown, so that the perforations 5 open out on the stiffener 1. Therefore, the thermoforming hot air reheats the stiffener 1 directly by circulating in the perforations 5. These perforations 5 enable the stiffener 1 to reach the necessary temperature for its thermoforming without the other materials, in particular the inner lining, being subject to excessive heat. Thus, the foot P, which is positioned in the liner CH for shaping during the cooling off, is not burned by the inner lining.

The tests have shown that all types of perforations 5 are suited for supplying the stiffener 1 with hot air. The perforations 5, whose average diameter is within the range of about 1 and 3 mm, promote the quick heating of the stiffener 1, on the one hand; the perforations 5, comparable to micro-perforations having an average diameter comprised within the range of about 0.1 and 1 mm, make it possible to better diffuse the heat in the comfort element 4 while also heating the stiffener 1.

Figure 3:
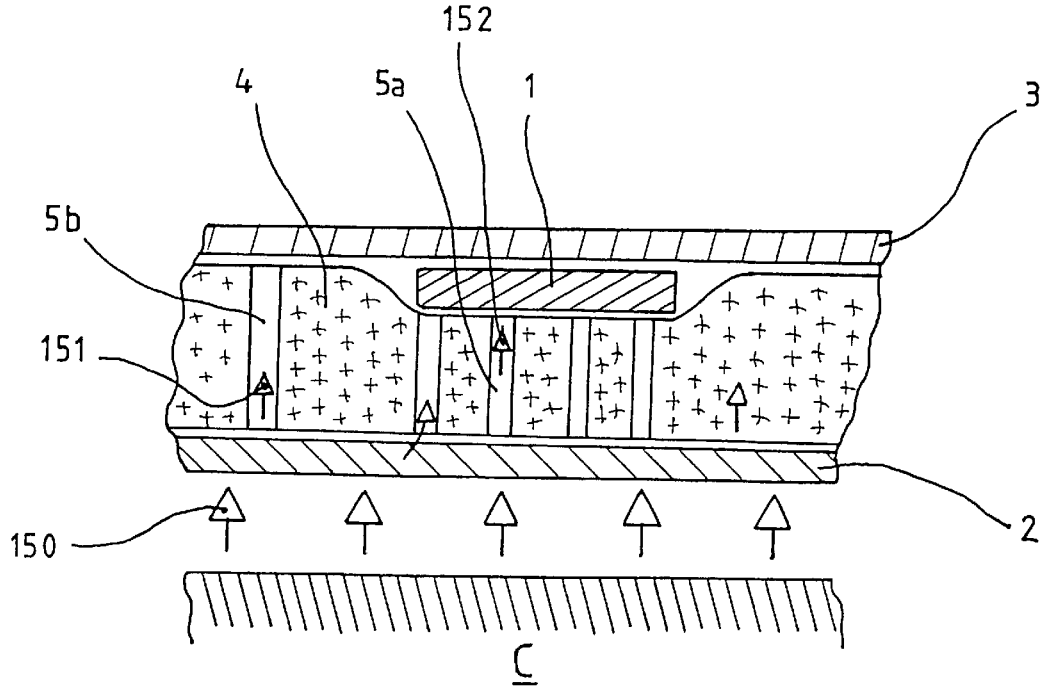
FIG. 3 shows a cross-section along the thickness of the upper according to the first embodiment.

FIG. 3 shows a transverse cross-section along the thickness of the liner shown in the previous figures, and specifies the travel of the thermoforming heat through the thickness. To undertake the thermoforming heating step in a store, a heating device C is introduced within the liner, which propels hot air 150. The thermoforming process as well as the heating apparatus C necessary to obtain the thermoforming are known and described in the document U.S. Pat. No. 5,894,680. This hot air 150 reheats the interior of the liner and penetrates into the inner lining 2; then a portion 151 of the hot air 150 penetrates into perforations 5*b* that do not open out on the stiffeners. This portion 151 of hot air makes it possible to reheat the constituent material of the comfort element 4 so as to bring it to the temperature necessary for a possible thermoforming.

The perforations 5*b* can extend right through the comfort element 4, or can include their end that is sealed and positioned on the side of the outer covering 3. This last arrangement makes it possible in particular to heat the comfort element 4 without heating the outer covering 3. Nevertheless, this process is slightly more difficult to implement than the through perforations. Another portion 152 of hot air 150 penetrates into perforations 5*a* that extend through the comfort element 4, and which open out on the stiffener 1 to reheat and place it at the optimum temperature to perform the thermoforming process, To implement the first embodiment of the upper O, shown in particular in FIG. 3, it is necessary that at least a fraction 5*a* of the set of perforations 5*a*, 5*b*, of the comfort element 4 open out on the stiffener 1. The perforation 5*a* open out on the other end of the lining 2 that has good air permeability.

Figure 4:
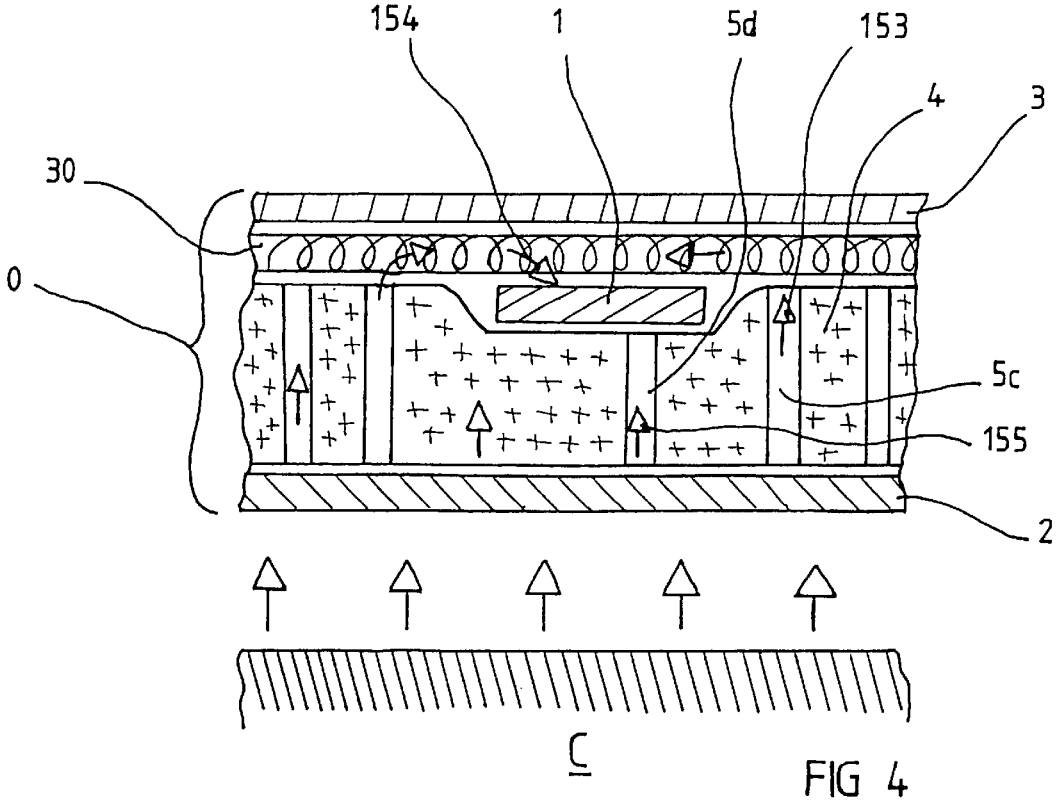
FIG. 4 shows a cross-section along the thickness of the upper according to the second embodiment.

FIG. 4 shows a transverse cross-section that shows the travel of hot air during the thermoforming heating step for an upper O according to the second embodiment. This embodiment seeks to optimize the speed at which the stiffener 1 is heated for its thermoforming. The comfort element 4 includes at least a fraction 5*c* of the set of the perforations 5*c*, 5*d*, that is located outside the stiffener 1. The perforations 5*c* open out at one of their ends on the inner lining 2 that is in direct contact with the heating device C arranged within the liner. These perforations open out at their other ends on a ventilated layer 30 that is positioned so as to be inserted between the comfort element 4 and the outer covering 3. In the area of the stiffener 1, the ventilated layer 30 is positioned between the stiffener 1 and the outer covering 3. This ventilated layer 30 has a certain thickness and is permeable to air, mainly lengthwise. Thus, the hot air 153, which circulates in the perforations 5*c* coming from the heating device C, is diffused and circulates by a component 154 in the thickness of the ventilated layer 30. This hot air 154, circulating parallel to the upper O, reheats the stiffener 1 from the top. Furthermore, perforations 5*d*, positioned beneath the stiffener 1, enable the hot air 155 coming from the heating device C to heat the stiffener 1 from the bottom.

The ventilated layer 30 could advantageously be made of a tri-dimensional textile having a thickness in the range of about 1 and 3 mm. The use of his ventilated layer 30 is more particularly adapted to the use of comfort elements 4 of the thermoformable type. Indeed, the thickness of the ventilated layer 30 is used during the heating step, then this thickness becomes practically zero because of the expansion of the material of this comfort element 4 during the thermoforming cooling step. Thus, during the practice of the sport, the ventilated layer 30 is compressed and does not generate any inaccuracy or clearances between the liner and the boot that envelopes the liner.

The present invention is not limited to the particular embodiments described hereinabove, which are provided for guidance only, but encompasses all of the similar or equivalent embodiments that apply in particular to any footwear including an upper and a sole.

What is claimed is:

1. A snowboard boot comprising:

a comfort upper comprising:

an inner lining for contact with a foot of a wearer of the footwear;

an outer covering;

a stiffener, positioned between the inner lining and the outer covering, said stiffener being made of a thermoformable material capable of being configured to a contour of a user's foot after the comfort upper has been assembled; and a flexible outer envelope surrounding said inner lining.

2. A snowboard boot according to claim 1, wherein the stiffener is positioned laterally on the upper in an area adapted to cover an ankle of the wearer of the boot.

3. A snowboard boot according to claim 1, wherein the stiffener is configured symmetrically with respect to a longitudinal vertical plane of the foot.

4. A snowboard boot according to claim 1, further comprising a tightening system comprising at least one fastener arranged on one of a plurality of portions of the upper to be brought closer together by means of said tightening system, the stiffener including at least one arm having an end positioned substantially beneath the fastener.

5. A snowboard boot according to claim 1, wherein the stiffener includes at least one recess in an area which is adapted to cover a malleolus of an ankle.

6. A snowboard boot according to claim 1, wherein the thermoformable material is a material that is thermoformable within a temperature range of about 100° C. to 140° C.

7. A snowboard boot according to claim 1, wherein said comfort upper constitutes a comfort liner, internal to the snowboard boot.

8. A boot including an upper according to claim 1, wherein said thermoformable material of said stiffener is capable of being configured to the contour of the user's foot after said boot has been assembled.

9. A snowboard boot according to claim 1, further comprising a tightening system comprising a lacing and a plurality of fasteners arranged on a pair of lateral portions of the upper to be brought closer together by means of said lacing, said stiffener comprising at least one upwardly and forwardly extending arm, at least one of said fasteners being supported on said arm.

10. A snowboard boot according to claim 1, wherein said stiffener is made of a textile material impregnated with a thermoplastic resin.

11. A snowboard boot according to claim 1, further comprising at least one comfort element, positioned between the inner lining and the stiffener, said comfort element being softer than the stiffener, and wherein the comfort element includes perforations.

12. A snowboard boot according to claim 11, wherein the comfort element is made of a thermoformable material.

13. A snowboard boot according to claim 11, wherein at least a fraction of the perforations of the comfort element opens out on the stiffener.

14. A snowboard boot according to claim 1, wherein said stiffener comprises a rearwardly positioned band located above a heel area of the inner lining.

15. A snowboard boot according to claim 14, wherein said stiffener includes an opening in said heel area of the inner lining.

16. An article of footwear comprising:

a comfort upper comprising:

an inner lining for contact with a foot of a wearer of the article of footwear;

an outer covering;

a stiffener, positioned between the inner lining and the outer covering, said stiffener being made of a thermoformable material capable of being configured to a contour of a user's foot while positioned between the inner lining and the outer covering; and an outer envelope surrounding said comfort upper.

17. An article of footwear according to claim 1, wherein said stiffener includes an opening in said heel area of the inner lining.

18. An article of footwear according to claim 1, wherein said outer envelope is flexible.

19. An article of footwear according to claim 1, wherein said outer envelope is rigid.

20. An article of footwear according to claim 16, wherein said stiffener is made of a textile material impregnated with a thermoplastic resin.

21. An article of footwear according to claim 16, wherein said stiffener is positioned laterally on said upper in an area adapted to cover an ankle of the wearer of the article of footwear.

22. An article of footwear according to claim 16, wherein said stiffener is configured symmetrically with respect to a longitudinal vertical plane of the foot.

23. An article of footwear according to claim 16, further comprising a tightening system comprising at least one fastener arranged on one of a plurality of portions of said upper to be brought closer together by means of said tightening system, said stiffener including at least one arm having an end positioned substantially beneath said fastener.

24. An article of footwear according to claim 16, wherein said stiffener includes at least one recess in an area which is adapted to cover a malleolus of an ankle.

25. An article of footwear according to claim 16, wherein said thermoformable material is a material that is thermoformable within a temperature range of about 100° C. to 140° C.

26. An article of footwear according to claim 16, wherein said thermoformable material of said stiffener is capable of being configured to the contour of the user's foot after said boot has been assembled.

27. An article of footwear according to claim 16, further comprising a tightening system comprising a lacing and a plurality of fasteners arranged on a pair of lateral portions of the comfort upper to be brought closer together by means of said lacing, said stiffener comprising at least one upwardly and forwardly extending arm, at least one of said fasteners being supported on said arm.

28. An article of footwear according to claim 27, wherein said stiffener comprises a rearwardly positioned band located above a heel area of the inner lining.

29. An article of footwear according to claim 16, further comprising at least one comfort element, positioned between said inner lining and said stiffener, said comfort element being softer than said stiffener, said comfort element including perforations.

30. An article of footwear according to claim 29, wherein said comfort element is made of a thermoformable material.

31. An article of footwear according to claim 29, wherein at least a fraction of the perforations of said comfort element opens out on said stiffener.

* * * * *